United States Patent [19]

Paul

[11] Patent Number: 4,953,714

[45] Date of Patent: Sep. 4, 1990

[54] BOOT HANGING DEVICES

[75] Inventor: Stanley M. Paul, Greenwich, Conn.

[73] Assignee: Paul Associates, Inc., Long Island, N.Y.

[21] Appl. No.: 472,331

[22] Filed: Jan. 29, 1990

[51] Int. Cl.[5] ..... A47F 5/00

[52] U.S. Cl. ..... 211/36; 211/89; 211/94; 211/DIG. 1; 248/206.5; 248/316.5

[58] Field of Search ..... 211/34, 36, DIG. 1, 211/94, 89; 248/206.5, 316.5, 316.7

[56] References Cited

U.S. PATENT DOCUMENTS

| | | | |
|---|---|---|---|
| 2,515,757 | 7/1950 | Browner | 248/206.5 X |
| 2,943,899 | 7/1960 | Beller | 211/34 X |
| 3,194,405 | 7/1965 | Hawie | 211/89 |
| 3,239,179 | 3/1966 | Margulis | 248/206.5 |
| 3,756,550 | 9/1973 | Kollitz | 248/206.5 |
| 4,830,322 | 5/1989 | Gary | 211/89 X |

*Primary Examiner*—Robert W. Gibson, Jr.
*Attorney, Agent, or Firm*—Darby & Darby

[57] ABSTRACT

Disclosed is a device for hanging boots comprising a mounting bar and a plurality of clips, one for each boot. The mounting bar can be secured to a vertical or horizontal surface and includes a metallic contact surface and an upwardly directed supporting surface. Each clip includes two spring-biased leg members for grasping an article and a magnet for securing the clip to the metallic contact surface of the mount. The upwardly directed supporting surface prevents the clips from sliding off the contact surface because of the weight of the supported boot.

7 Claims, 1 Drawing Sheet

BOOT HANGING DEVICES

Field of the Invention

The present invention relates to a device for hanging boots or shoes in a closet or the like for convenient storage and access.

Background of the Invention

Currently, boots are a popular form of footwear. Very often, women's high fashion boots are made of flexible materials which tend to fold over on themselves and, therefore, are substantially less convenient to store in the wearer's closet than shoes.

Object of the Invention

An object of the present invention is to provide a means for conveniently storing boots in a closet or the like for ready access by the user.

Summary of the Invention

In accordance with the invention, a retaining clip is provided for each boot. Each clip includes a portion for grasping a boot and a magnetic portion which is magnetically secured to a metallic mounting member attached to a wall of the closet. The mount and clips include complementary shaped surfaces for providing mechanical support for the clips.

Description of the Preferred Embodiments

Figure 1:
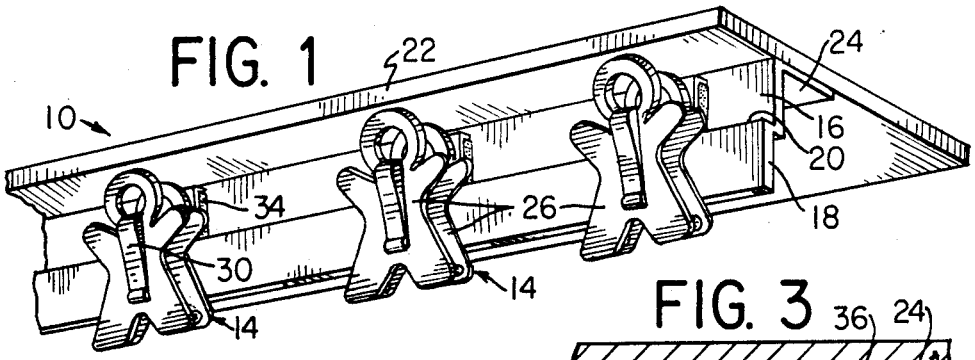
FIG. 1 is an isometric view of one embodiment of a hanging device in accordance with the present invention showing clips attached to a mount.

Referring to FIG. 1 there is shown a device 10 for hanging boots 11 according to one embodiment of the invention. The device consists of a mounting bar 12 and clips 14. A separate clip 14 is provided for each boot 11. The mounting bar 12 is preferably made entirely out of a magnetically influenced metal such as steel, but can be also made from other materials as long as a portion of it is magnetically influenced. The mounting bar 12 comprises a contact surface 16 and a ledge 18 having an upwardly directed supporting surface 20. The ledge 18 may be made from any material including plastic. In one embodiment, the mounting bar 12 is attached underneath a horizontal support surface such as a shelf 22 by means of an angled bracket 24, as shown in FIG. 1.

In the preferred embodiment as shown in FIG. 1, the angled bracket 24, the contact surface 16 and the ledge 18 are formed from the same piece of material, such as sheet steel, which is long enough to accommodate several clips 14. However, the ledge 18 should be secured to the lower portion of the front surface of a steel contact surface 16 so as to create an upwardly directed supporting surface 20; separate angled brackets 24 of sufficient size and strength could be attached to the back surface of the mounting bar 12 so that the entire assembly 10 could be secured to the lower surface of the shelf 22.

Figure 2:
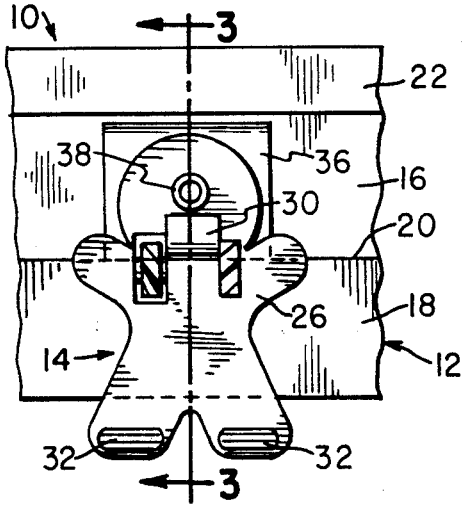
FIG. 2 is a partial cross sectional view showing a clip in a mounted position along the mount in accordance with the present invention taken along lines 2—2 of FIG. 3.
Figure 3:
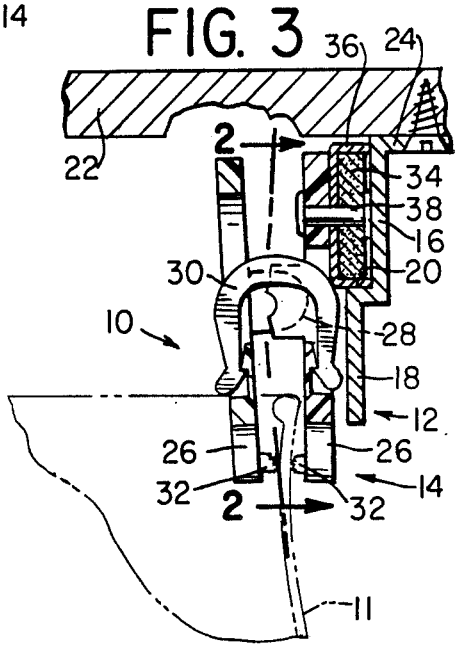
FIG. 3 is a partial cross sectional view of the embodiment shown FIG. 1 taken along lines 3—3 of FIG. 2 showing a boot being grasped by the clip.

Referring now to FIGS. 2 and 3, details of the preferred clip 14 are shown. In order to hold the article 11, the clip 14 is provided with an article-grasping portion which includes two legs 26 secured together at a hinge point 28 so that they can pivot about the hinge point 28 with respect to each other. The lower ends of the legs 26 are spring-biased towards each other by a spring member 30. Adjacent to the lower end of each leg 26 is a gripping detent 32 which engages the boot 11 to be secured.

Attached to an upper portion of one leg 26 is a magnet 34. In the preferred embodiment, the magnet 34 includes a metal jacket 36 and is attached to the leg 26 with a rivet 38. The magnet 34 can be any desired shape including square, round and triangular, but must form a strong enough attraction with the metallic contact surface 16 to support the boot 11 to be hung. The construction of the clip per se forms no part of this invention.

The contact surface 16 is preferably large enough to accommodate the entire contacting surface of the magnet 34. The upwardly directed supporting surface 20 should be large enough to contact the outer surface of the magnet jacket 36 and prevent the magnet and the clip from sliding off the contact surface 16.

The grasping portion of each clip 14 is preferably strong enough that the article will be securely held, but not so strong as to be difficult to operate or damage the article's surface. The legs 26 should be long enough so that when the clip 14 is attached to the mounting bar 12, the gripping detents 32 of each clip 14 lie below the lower edge of the ledge 18. This arrangement avoids interference between the mounting bar 12 and the boot 11.

Figure 4:
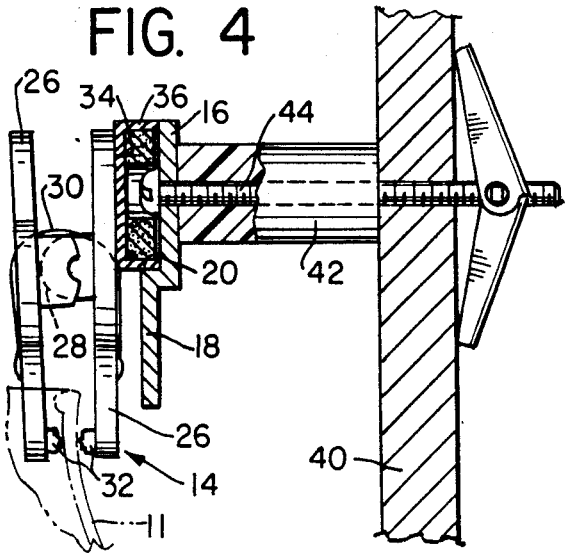
FIG. 4 is a partial cross sectional view showing a second embodiment of the present invention.

FIG. 4 shows another embodiment of the present invention where the mounting bar 12 is attached to a vertical supporting surface such as a wall 40. The mounting bar 12 is held a predetermined distance from the wall 40 by a spacer 42. The spacer is preferably made from any strong lightweight material such as plastic, and includes a central passage along its length for accommodating a fastener 44. It is important that the spacer 42 be of sufficient strength to prevent the mounting bar 12 from sagging under the load of hung boots 11.

As shown in FIG. 4, the mounting bar 12 is attached to the spacer 42 and the wall 40 by fasteners 44, such as the self-engaging molly type (one bolt for each spacer 42). The fastener 44 extends through an opening provided along either the contact surface 16 or the ledge 18, through the central passage of the spacer 42, through an opening formed in the wall 40 (depending on the desired location of the device 10) and threaded to the mating wing-nut portion of the molly bolt. The head of the fastener 44 preferably lies flush on the contact surface 16 so as not to interfere with the magnets 34.

Figure 5:
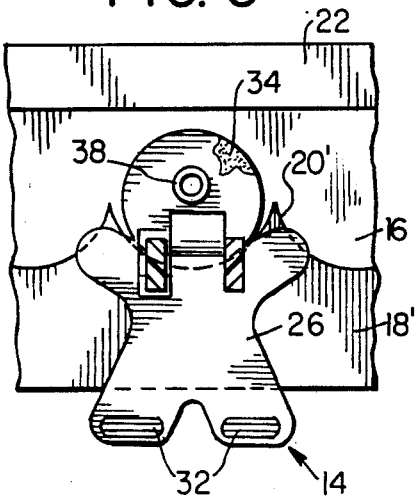
FIG. 5 is a partial cross-sectional view showing another embodiment of the present invention.

FIG. 5 shows a further modified embodiment of the hanging device with a ledge 18′ having an upwardly directed supporting surface 20′ that is scalloped so that a round magnet 34 of each clip 14 can be automatically spaced evenly from other clips along the contact surface 16′. In this case, the diameter of the circular magnet jacket 36′ should be slightly smaller than that of the scallop arc diameter. This arrangement causes the magnet of each clip 14 (laden with a boot) to "funnel" into the valley of the nearest scallop portion as it slides down into contact with the upwardly directed supporting surface 20.

To secure a boot, the user removes an empty clip 14 from the contact surface 16 of the mounting bar 12 by overcoming the magnetic attraction force, pushes the upper ends of the legs 26 together against the action of the spring member 30, and applies the gripping detents 32 around the boot. The user then places the magnet back into contact with the contact surface 16. If the boot 11 is heavy, the magnet 34 may slide downward along the contact surface 16. The upwardly directed supporting surface 20 will prevent the magnet 34 from sliding off the contact surface 16.

To remove a boot 11, the user merely pulls the boot 11 (with the clip 14 attached) from the mounting bar 12, removes the clip 14 from the boot 11 and returns the clip 14 to the mounting bar 12 for storage.

What is claimed is:

1. A device for hanging articles of clothing such as footwear, comprising:

a mounting bar adapted to be attached to a supporting surface, said mounting bar having a metallic contact surface and a generally horizontal flange, said flange defining an upwardly directed supporting face;

a clip for securing said article to said mounting bar, said clip comprising means for grasping said article and a magnet for selectively coupling with said metallic contact surface, said magnet being supported by said upwardly directed supporting face so that said magnet is prevented from sliding off said metallic contact surface due to the weight of said article.

2. The device of claim 1 wherein said supporting surface is generally vertical.

3. The device of claim 1 wherein said supporting surface is generally horizontal.

4. The device of claim 1 wherein said mounting bar is a track of predetermined length capable of accommodating a plurality of clips.

5. The device of claim 2 further comprising a spacer for affixing said mounting bar a predetermined distance from said generally vertical supporting surface thereby preventing said hanging article from contacting said vertical supporting surface.

6. The device of claim 3 further comprising an angled bracket for affixing said mounting bar to said horizontal supporting surface.

7. The device of claim 4 wherein said track includes a means for segmenting so that said articles automatically hang a predetermined distance apart.

* * * * *